US011260410B2

(12) United States Patent
Xu

(10) Patent No.: US 11,260,410 B2
(45) Date of Patent: Mar. 1, 2022

(54) ALL-PLASTIC LIQUID DISPENSER

(71) Applicant: Ningbo Shunde Medical Technology Co., Ltd., Zhejiang (CN)

(72) Inventor: Rulong Xu, Zhejiang Province (CN)

( * ) Notice: Subject to any disclaimer, the term of this patent is extended or adjusted under 35 U.S.C. 154(b) by 0 days.

(21) Appl. No.: 17/100,961

(22) Filed: Nov. 23, 2020

(65) Prior Publication Data

US 2021/0379615 A1 Dec. 9, 2021

(30) Foreign Application Priority Data

Jun. 5, 2020 (CN) ..... 202021019919.2
Aug. 13, 2020 (CN) ..... 202010814647.3

(51) Int. Cl.
*B05B 11/00* (2006.01)

(52) U.S. Cl.
CPC ..... *B05B 11/3042* (2013.01); *B05B 11/0008* (2013.01); *B05B 11/3028* (2013.01)

(58) Field of Classification Search
CPC ..... B05B 11/3042; B05B 11/0008; B05B 11/3028; B05B 9/0811
See application file for complete search history.

(56) References Cited

U.S. PATENT DOCUMENTS 6,360,919 B1 * 3/2002 Brule ..... B05B 11/00444 222/189.09
6,729,500 B1 * 5/2004 Dobbs ..... B05B 11/3001 222/78
6,840,408 B1 * 1/2005 Foster ..... B05B 11/3074 222/190
8,496,142 B2 * 7/2013 Uehira ..... B05B 11/3087 222/190
2005/0115988 A1 * 6/2005 Law ..... B05B 11/3087 222/145.5
2005/0224519 A1 * 10/2005 Law ..... B05B 11/3087 222/190

* cited by examiner

*Primary Examiner* — Vishal Pancholi
(74) *Attorney, Agent, or Firm* — Prakash Nama; Global IP Services, PLLC

(57) ABSTRACT

A liquid dispenser, having a large ring, a connecting cover, and a hollow pump frame, the pump frame is movably clamped to the interior of the large ring, the top of the pump frame extends to the outer side of the top of the large circle, a bottom protruding portion of the connecting cover extends into a top groove of the pump frame so as to be movably clamped thereto, a first air outlet is provided on both sides of the bottom of the connecting cover, and a second air outlet in communication with the first air outlet is provided to penetrate through the pump frame. The first air outlet, the second air outlet, the first liquid outlet, and the second liquid outlet can be opened and closed by rotating the connecting cover to change a position relationship between the connecting cover and the pump frame.

8 Claims, 6 Drawing Sheets

ALL-PLASTIC LIQUID DISPENSER

BACKGROUND OF THE INVENTION

The present application relates to the technical field of dispensers, in particular to an all-plastic liquid dispenser.

A liquid dispenser generally consists of two portions: a pump core and a bottle body; and a working principle thereof is as follows: the inner volume of the bottle body is periodically increased and reduced by pressing a head cap to move, so that the pressure of the liquid increases, thereby sucking and discharging the liquid in the bottle body. However, in the use of the existing liquid dispenser, the liquid remained in the pump core is prone to contamination after a long-time contact with a metal spring, and the remained liquid thus is likely to cause harm to the human body during use. According to the national plan for 2025 and the European Union recycling standards, the recycling of the metal spring liquid dispenser (pump) does not satisfy the international standards.

Therefore, it is necessary to provide an all-plastic liquid dispenser to solve the above problem.

BRIEF SUMMARY OF THE INVENTION

The objective of the present application is to provide an all-plastic liquid dispenser to solve the above problem in the prior art.

In order to achieve the above objective, the present application provides the following technical solution: an all-plastic liquid dispenser, comprising a large ring, a connecting cover, and a hollow pump frame, wherein the pump frame is movably clamped to the interior of the large ring, the top of the pump frame extends to the outer side of the top of the large ring, a bottom protruding portion of the connecting cover extends into a top groove of the pump frame so as to be movably clamped thereto, a first air outlet is provided on both sides of the bottom of the connecting cover connected to the pump frame, a second air outlet in communication with the first air outlet is provided to penetrate through the pump frame, the bottom of the second air outlet extends into an inner cavity of the large ring, a first liquid outlet is provided at both sides of the axial center of the pump frame to penetrate through the pump frame, the first liquid outlet is in communication with a hollow portion of the pump frame, and a second liquid outlet in one-to-one correspondence to the first liquid outlet is provided to penetrate through the connecting cover; and a press cover is disposed on the top of an inner cavity of the connecting cover, the press cover is fixedly disposed on a top protruding portion of the connecting cover, a press cover channel is disposed at the axial center of the press cover to penetrate through the press cover, and the press cover channel can be in communication with the first liquid outlet and the second liquid outlet.

In an example, an elastomer pump core is disposed on the top of the connecting cover, the bottom of the elastomer pump core extends to the inner cavity of the connecting cover so as to be rotatably connected thereto, the bottom of the elastomer pump core abuts on the press cover, a sealing cover is disposed to surround the outer side of the elastomer pump core, a head cap is sleeved on the outer side of the top of the sealing cover, a protruding portion of an inner cavity of the head cap extends into the elastomer pump core, and the bottom of a bottom wall of the head cap extends into the connecting cover.

In an example, an upper sealing ring and a lower sealing ring are disposed on the top of the elastomer pump core, a third liquid outlet is provided between the upper sealing ring and both sides of the protruding portion of the inner cavity of the head cap, the third liquid outlet penetrates through the top of the sealing cover, and a liquid outflow channel in communication with the third liquid outlet is disposed to penetrate through one side of the head cap.

In an example, a suction tube is fixedly disposed at the bottom axial center of the pump frame, and the suction tube is in communication with the first liquid outlet.

In an example, a gasket is disposed to surround the bottom of a side wall of the pump frame, and the gasket is fixedly disposed in the inner cavity of the large ring.

In an example, two first air outlets and two second air outlets are provided, and the two first air outlets or two second air outlets are arranged symmetrically about the axis of the pump frame.

In an example, two first liquid outlets are provided, and the two first liquid outlets are arranged symmetrically about the axis of the pump frame.

In an example, a sealing plug is fitted right above the press cover channel.

Technical effects and advantages of the present application:

1. In the present application, a structural improvement is made to modularize the connecting cover, the pump frame, and the elastomer pump core, and the first air outlet, the second air outlet, the first liquid outlet, and the second liquid outlet can be opened and closed by rotating the connecting cover to change a position relationship between the connecting cover and the pump frame, so as to implement functions of liquid discharge sealing and air supplementation. In addition, in the present application, the structure is simple, the operation is easy, and compared with the existing integrated structure, this structure can significantly improve the practical flexibility.

2. When the head cap is pressed, since the elastomer pump core is provided with an upper sealing site and a lower sealing site, when subjected to pressure, the elastomer pump core first applies pressure to the sealing plug by means of compressed air such that the sealing plug is pressed to the press cover channel, in which case the third liquid outlet is opened, and the upper sealing ring automatically opens when subjected to specific pressure, thereby discharging the liquid; when the elastomer pump core resiles, the upper sealing ring plays a sealing role, the lower sealing ring is opened, the liquid in the upper bottle is sucked at the same time, and the liquid in the elastomer pump core flows out via the third liquid outlet; and when the head cap bounces (due to elastic force of the elastomer), the third liquid outlet is closed, the upper sealing ring plays a sealing role, a space in the elastomer pump core is enlarged, the pressure is reduced, and the liquid passes through a hole 8, flicks the lower sealing ring, reaches the interior of the elastomer pump core via the suction tube, and then is stored in the elastomer pump core, wherein the spatial sealability can be ensured in a state of no pressing such that the liquid is sterile.

Figure 1:
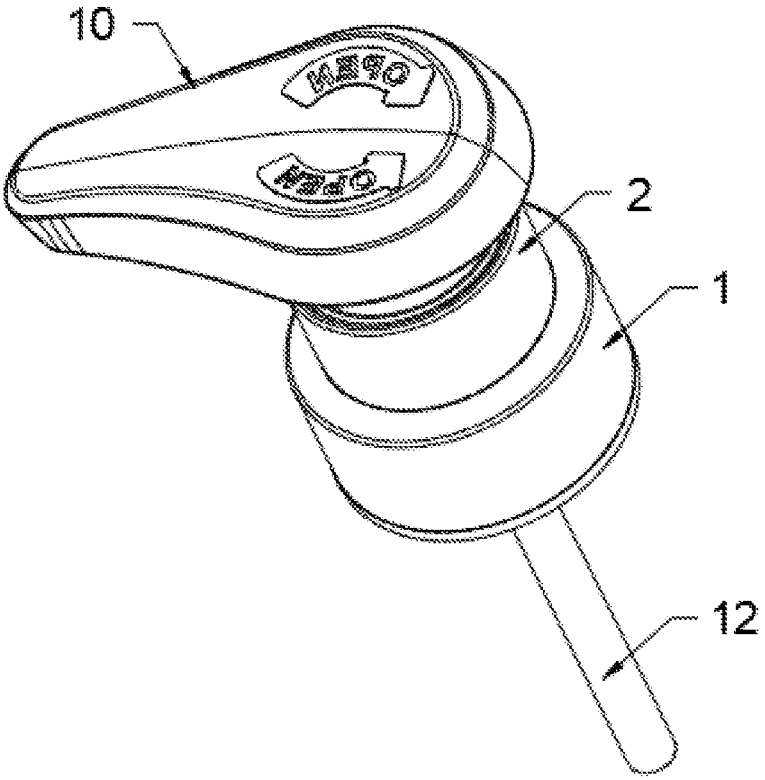
FIG. 1 is a schematic view of an overall structure according to the present application.

In the drawings: 1. large ring; 2. connecting cover; 3. pump frame; 4. first air outlet; 5. second air outlet; 6. first liquid outlet; 7. press cover; 8. press cover channel; 9. elastomer pump core; 10. head cap; 11. third liquid outlet; 12. suction tube; 13. gasket; 14. sealing plug; 15. liquid outflow channel; 16. sealing cover.

DETAILED DESCRIPTION OF THE INVENTION

The technical solution in the embodiments of the present application will be described below clearly and completely. Apparently, the described embodiments are merely a part of the embodiments of the present application, instead of all of them. All other embodiments obtained by those skilled in the art based on the embodiments of the present application without contributing any inventive labor shall fall within the protection scope of the present application.

The present application provides an all-plastic liquid dispenser including a large ring 1, a connecting cover 2, and a hollow pump frame 3. The pump frame 3 is movably clamped to the interior of the large ring 1, the top of the pump frame 3 extends to the outer side of the top of the large ring 1, and a bottom protruding portion of the connecting cover 2 extends into a top groove of the pump frame 3 so as to be movably clamped thereto. A first air outlet 4 is provided on both sides of the bottom of the connecting cover 2 connected to the pump frame 3, a second air outlet 5 in communication with the first air outlet 4 is provided to penetrate through the pump frame 3, and the bottom of the second air outlet 5 extends into an inner cavity of the large ring 1. Two first air outlets 4 and two second air outlets 5 are provided, and the two first air outlets 4 or two second air outlets 5 are arranged symmetrically about the axis of the pump frame 3.

A first liquid outlet 6 is provided at both sides of the axial center of the pump frame 3 to penetrate through the pump frame, the first liquid outlet 6 is in communication with a hollow portion of the pump frame 3, and a second liquid outlet in one-to-one correspondence to the first liquid outlet 6 is provided to penetrate through the connecting cover 2. Two first liquid outlets 6 are provided, and the two first liquid outlets 6 are arranged symmetrically about the axis of the pump frame 3.

A press cover 7 is disposed on the top of an inner cavity of the connecting cover 2, the press cover 7 is fixedly disposed on a top protruding portion of the connecting cover 2, a press cover channel 8 is disposed at the axial center of the press cover 7 to penetrate through the press cover, and the press cover channel 8 can be in communication with the first liquid outlet 6 and the second liquid outlet. A sealing plug 14 is fitted right above the press cover channel 8.

In an example, an elastomer pump core 9 is disposed on the top of the connecting cover 2, the bottom of the elastomer pump core 9 extends to the inner cavity of the connecting cover 2 so as to be rotatably connected thereto, the bottom of the elastomer pump core 9 abuts on the press cover 7, a sealing cover 16 is disposed to surround the outer side of the elastomer pump core 9, a head cap 10 is sleeved on the outer side of the top of the sealing cover 16, a protruding portion of an inner cavity of the head cap 10 extends into the elastomer pump core 9, and the bottom of a bottom wall of the head cap 10 extends into the connecting cover 2.

In addition, an upper sealing ring and a lower sealing ring are disposed on the top of the elastomer pump core 9, a third liquid outlet 11 is provided between the upper sealing ring and both sides of the protruding portion of the inner cavity of the head cap 10, the third liquid outlet 11 penetrates through the top of the sealing cover 16, and a liquid outflow channel 15 in communication with the third liquid outlet 11 is disposed to penetrate through one side of the head cap.

A suction tube 12 is fixedly disposed at the bottom axial center of the pump frame 3, and the suction tube 12 is in communication with the first liquid outlet 6. A gasket 13 is disposed to surround the bottom of a side wall of the pump frame 3, and the gasket 13 is fixedly disposed in the inner cavity of the large ring 1.

Figure 5:
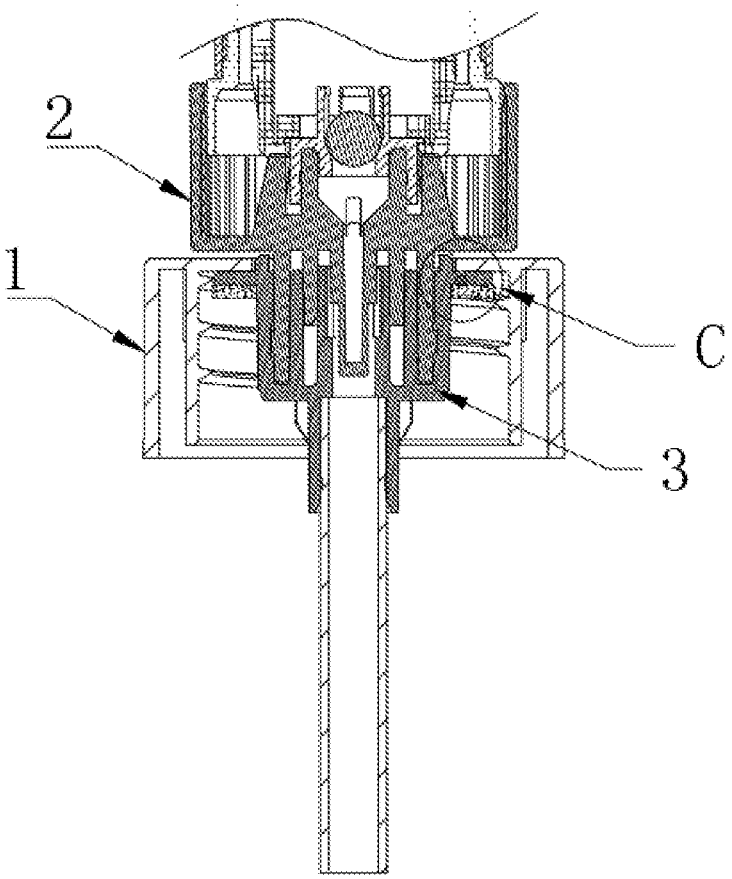
FIG. 5 is a schematic structural view of a second air supplementation structure according to the present application.
Figure 6:
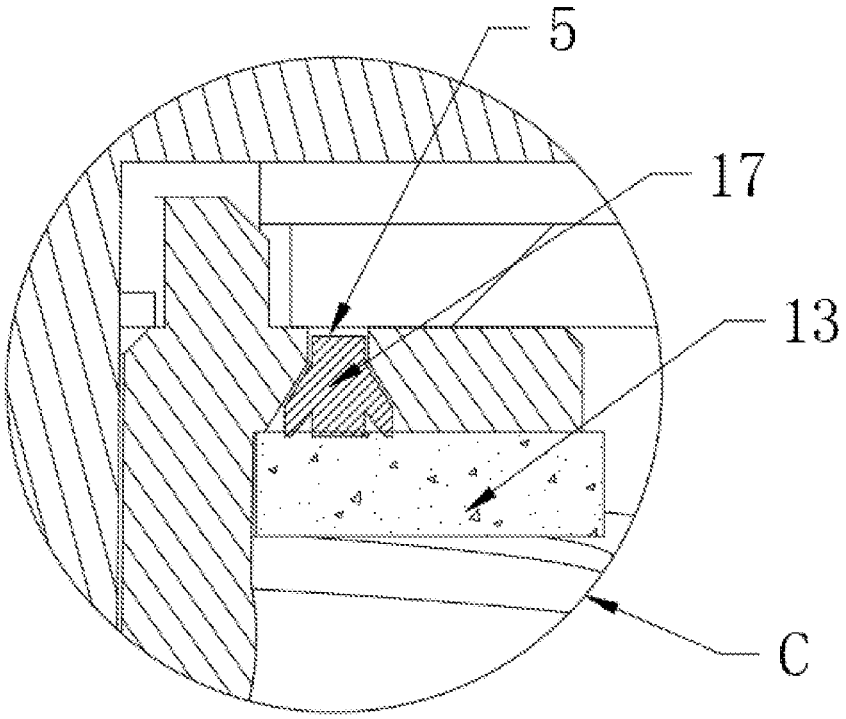
FIG. 6 is an enlarged schematic view of a structure at position C in FIG. 5 according to the present application.

In addition, air supplementation can be performed in another mode, that is, the second air outlet 5 is disposed on the pump frame 3, as shown in FIGS. 5 and 6, and a first sealing plug is filled in the second air outlet 5 to achieve a function of a check valve, thereby preventing liquid outflow.

More specifically, the head cap 10 is made of an elastomer material having elastic properties. In the present application, elastic materials used for the elastomer pump core 9 and the head cap 10 are not specifically defined, and specific materials can be selected according to a specific production situation.

Figure 3:
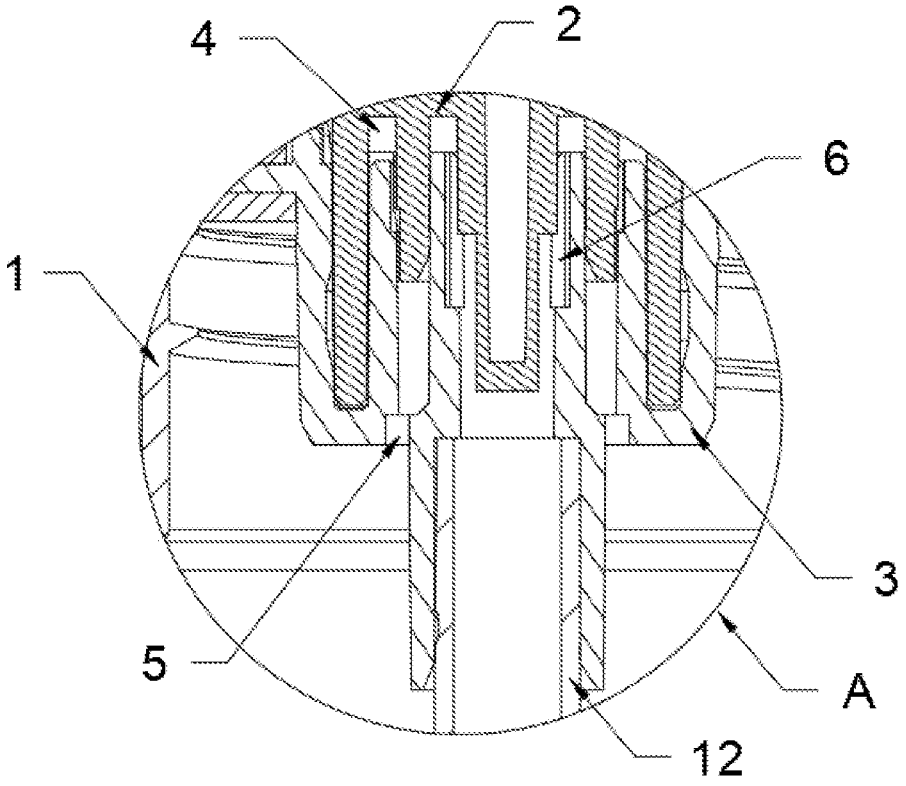
FIG. 3 is an enlarged schematic view of a structure at position A in FIG. 2 according to the present application.
Figure 4:
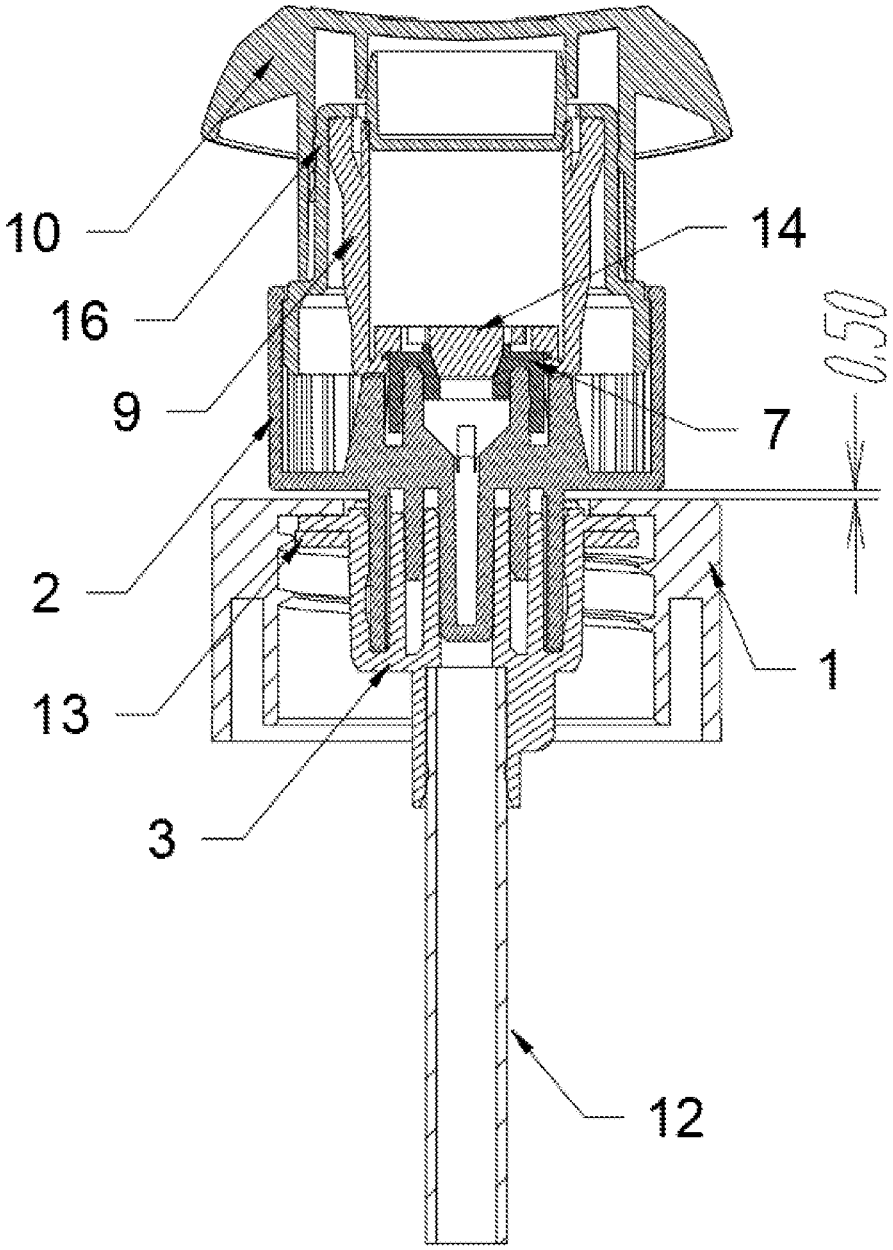
FIG. 4 is a schematic view of the structure wherein the liquid outflow channel and the air supplementation channel are closed according to the present application.

In addition, in closed and open states of the connecting cover 2, there is a 0.5 mm height difference between the connecting cover 2 and the pump frame 3, so as to ensure the air supplementation and a sealing state, as shown in FIG. 3.

Figure 2:
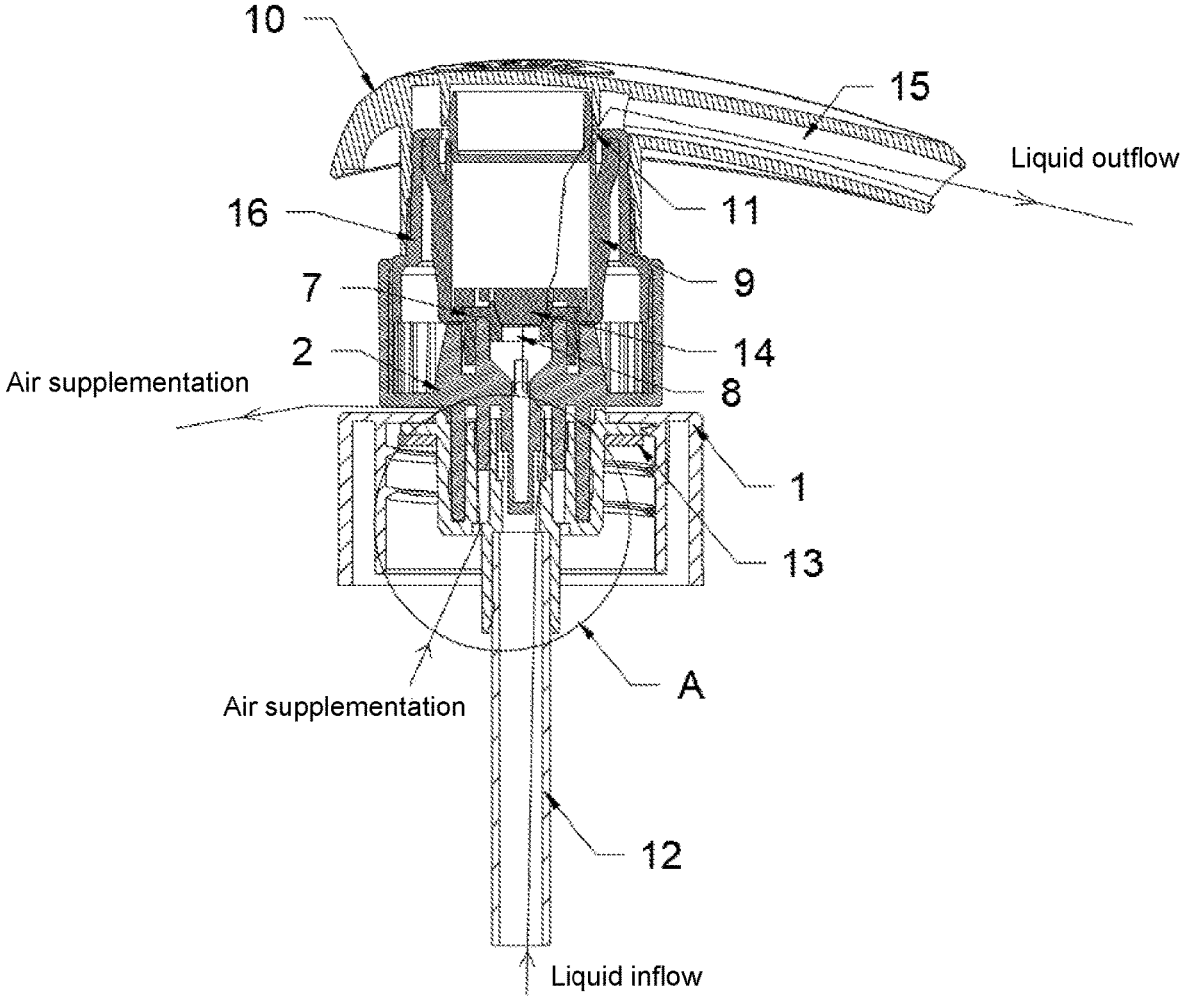
FIG. 2 is a schematic section view of the overall structure wherein a liquid outflow channel and an air supplementation channel are opened according to the present application.

The working principle of the present application:

During use, the head cap 10 is pressed, the third liquid outlet 11 is opened, and the liquid in the elastomer pump core 9 flows out from the liquid outflow channel 15 via the third liquid outlet 11, as shown in FIG. 2.

When pressing force is removed from the head cap 10, the head cap 10 bounces (due to elastic force of the elastomer), the third liquid outlet 11 is closed and sealed, a space in the elastomer pump core 9 is enlarged, the pressure is reduced, and the liquid reaches the interior of the elastomer pump core 9 via the suction tube 12 and then is stored in the elastomer pump core 9, wherein the sealability of the liquid storage space can be ensured such that a sealing state of the liquid is maintained, as shown in FIG. 3.

A sealing function is as follows: a relative position between the connecting cover 2 and the pump frame 3 is changed by rotating the connecting cover 2 left and right, such that the first liquid outlet 6 is aligned with the second liquid outlet, and then opening and closing of the entire liquid dispenser are implemented; and after the connecting cover 2 is rotated 90 degrees relative to the pump frame 3, the entire liquid dispenser is closed, such that the liquid in the bottle is isolated from the outer environment, thereby achieving the sealing function, as shown in FIG. 3.

An air supplementation function is as follows: the relative position between the connecting cover 2 and the pump frame 3 is changed by rotating the connecting cover 2 leftward and rightward, such that a protruding portion of the connecting cover 2 and a recess portion of the pump frame 3 cooperate with each other to lift the connecting cover 2, thereby implementing cooperation displacement, whereby the connecting cover 2 seals the first air outlet 4 to achieve a sealing effect; the leftward and rightward rotation of the connecting cover 2 stops when a protrusion on the connecting cover abuts on a protrusion on the pump frame, due to the existence of a height difference, when the head cap 10 is pressed, the connecting cover 2 drops at the same, a sealing channel between the connecting cover and the pump frame is opened, and air enters the bottle via the first air outlet 4 and the second air outlet 5, wherein the air supplementation function and the sealing function are implemented synchronously, as shown in FIGS. 2 and 3.

A pumping-out function is as follows:

First, the head cap 10 is pressed such that pressing acts on the elastomer pump core 9, resulting in deformation of the elastomer pump core 9, wherein a weakest root portion starts to sink and deform, then an upper portion of the elastomer pump core 9 is deformed and folded into two layers, an inner space of the elastomer pump core 9 shrinks until the bottom of the head cap 10 abuts on the connecting cover 2, in which case the inner space of the elastomer pump core 9 enters a smallest state, air inside the elastomer pump core 9 is compressed and then acts on an inner wall of the elastomer pump core 9, after the pressure reaches a specific value, a slice of the upper portion of the elastomer pump core 9 protrudes from the position where the inner wall is thinnest, and additionally, after the inner pressure of the elastomer pump core 9 is increased, a bottom circle point of the elastomer pump core 9 abuts on the press cover channel 8 on the press cover 7, so as to achieve a function of sealing the elastomer pump core 9.

After a hand is removed, the head cap 10 rises and recovers due to the resilience of the elastomer pump core 9, and an inner hole of the elastomer pump core 9 is expanded to generate negative pressure, wherein the upper slice portion of the elastomer pump core 9 first recovers and then attached to an inner circular wall of the head cap 10 to achieve a function of closing an upper liquid overflow port. In addition, the bottom circle point rises due to the negative pressure in the elastomer pump core 9, the press cover channel 8 on the press cover 7 thus is opened, and the liquid in the bottle reaches the interior of the elastomer pump core 9 via the suction pipe 12 and a channel formed by cooperation of the first liquid outlet 6 and the second liquid outlet on the pump frame 3, thereby achieving the liquid pumping-out function. That is, the liquid pumping-out function can be achieved by pressing the head cap 10 repeatedly.

Finally, it should be noted that only some embodiments of the present application are described above, and the present application is not limited thereto. Although the present application has been described in detail with reference to the foregoing embodiments, those skilled in the art can still modify the technical solutions described in the foregoing embodiments or make equivalent replacements to some technical features. Any modification, equivalent replacement, improvement, etc., made within the spirit and principle of the present application shall fall within the protection scope of the present application.

What is claimed is:

1. An all-plastic liquid dispenser, comprising a large ring (1), a connecting cover (2), and pump frame (3) which is hollow wherein the pump frame (3) is movably clamped to an interior of the large ring (1), a top of the pump frame (3) extends to an outer side of a top of the large ring (1), a bottom protruding portion of the connecting cover (2) extends into a top groove of the pump frame (3) so as to be movably clamped thereto, more than one first air outlet (4) are provided on both sides of a bottom of the connecting cover (2) connected to the pump frame (3), more than one second air outlet (5) in communication with said more than one first air outlet (4) are provided to penetrate through the pump frame (3), a bottom of each second air outlet (5) extends into an inner cavity of the large ring (1), more than one first liquid outlet (6) are provided at both sides of an axial center of the pump frame (3) to penetrate through the pump frame, the more than one first liquid outlet (6) are in communication with a hollow portion of the pump frame (3), and more than one second liquid outlet corresponding to the more than one first liquid outlet (6) respectively are provided to penetrate through the connecting cover (2); and a press cover (7) is disposed on a top of an inner cavity of the connecting cover (2), the press cover (7) is fixedly disposed on a top protruding portion of the connecting cover (2), a press cover channel (8) is disposed at an axial center of the press cover (7) to penetrate through the press cover, and the press cover channel (8) is in communication with the more than one first liquid outlet (6) and the more than one second liquid outlet.

2. The all-plastic liquid dispenser according to claim 1, wherein an elastomer pump core (9) is disposed on a top of the connecting cover (2), a bottom of the elastomer pump core (9) extends to the inner cavity of the connecting cover (2) so as to be rotatably connected thereto, the bottom of the elastomer pump core (9) abuts on the press cover (7), a sealing cover (16) is disposed to surround an outer side of the elastomer pump core (9), a head cap (10) is sleeved on an outer side of a top of the sealing cover (16), a protruding portion of an inner cavity of the head cap (10) extends into the elastomer pump core (9), and a bottom of a bottom wall of the head cap (10) extends into the connecting cover (2).

3. The all-plastic liquid dispenser according to claim 2, wherein an upper sealing ring and a lower sealing ring are disposed on a top of the elastomer pump core (9), a third liquid outlet (11) is provided between the upper sealing ring and both sides of the protruding portion of the inner cavity of the head cap (10), the third liquid outlet (11) penetrates through the top' of the sealing cover (16), and a liquid outflow channel (15) in communication with the third liquid outlet (11) is disposed to penetrate through one side of the head cap (10).

4. The all-plastic liquid dispenser according to claim 1, wherein a suction tube (12) is fixedly disposed at a bottom of the axial center of the pump frame (3), and the suction tube (12) is in communication with the more than one first liquid outlet (6).

5. The all-plastic liquid dispenser according to claim 1, wherein a gasket (13) is disposed to surround a bottom of a side wall of the pump frame (3), and the gasket (13) is fixedly disposed in the inner cavity of the large ring (1).

6. The all-plastic liquid dispenser according to claim 1, wherein two first air outlets (4) and two second air outlets (5) are provided, and the two first air outlets (4) or the two second air outlets (5) are arranged symmetrically about the axial center of the pump frame (3).

7. The all-plastic liquid dispenser according to claim 1, wherein two first liquid outlets (6) are provided, and the two first liquid outlets (6) are arranged symmetrically about the axial center of the pump frame (3).

8. The all-plastic liquid dispenser according to claim 1, wherein a sealing plug (14) is fitted right above the press cover channel (8).

* * * * *